US008627676B2

(12) United States Patent
Thiessen et al.

(10) Patent No.: US 8,627,676 B2
(45) Date of Patent: Jan. 14, 2014

(54) FLOW RATE CONTROL SYSTEM IN REFRIGERATION CIRCUITS, METHOD FOR CONTROLLING A REFRIGERATION SYSTEM AND A REFRIGERATION SYSTEM

(75) Inventors: Marcio Roberto Thiessen, Joinville (BR); Fabio Henrique Klein, Joinville (BR)

(73) Assignee: Whirlpool S.A., Sao Paulo-SP (BR)

( * ) Notice: Subject to any disclaimer, the term of this patent is extended or adjusted under 35 U.S.C. 154(b) by 1103 days.

(21) Appl. No.: 12/297,671
(22) PCT Filed: Apr. 17, 2007

(86) PCT No.: PCT/BR2007/000095

§ 371 (c)(1),
(2), (4) Date: Mar. 18, 2009

(87) PCT Pub. No.: WO2007/118293

PCT Pub. Date: Oct. 25, 2007

(65) Prior Publication Data

US 2009/0216384 A1 Aug. 27, 2009

(30) Foreign Application Priority Data

Apr. 19, 2006 (BR) ..... 0601298

(51) Int. Cl.
*F25B 13/00* (2006.01)
*F25B 41/04* (2006.01)
*G05D 7/00* (2006.01)

(52) U.S. Cl.
USPC ..... 62/324.6; 62/222; 700/282

(58) Field of Classification Search
USPC ..... 62/498, 222, 324.6; 700/282; 251/129.15
See application file for complete search history.

(56) References Cited

U.S. PATENT DOCUMENTS 4,720,982 A * 1/1988 Shimizu et al. ..... 62/204

(Continued)

FOREIGN PATENT DOCUMENTS

DE 31 29 410 2/1983

(Continued)

OTHER PUBLICATIONS

The International Search Report for PCT Application No. PCT/BR2007/000095; Filed Apr. 17, 2007; Date of Completion Oct. 5, 2007; Date of Mailing Oct. 12, 2007.

(Continued)

*Primary Examiner* — Chen Wen Jiang
(74) *Attorney, Agent, or Firm* — Alston & Bird LLP

(57) ABSTRACT

The present invention relates to a flow rate control system in refrigeration circuits, to a method for controlling a refrigeration system and to a refrigeration system properly speaking, which may include, for example, from a domestic refrigerator to an air conditioning system. In particular, the present invention is directed to a solution for the loss of efficiency in the expansion valve (17), when the system load varies, making the expansion valve (17) operate below its nominal capacity and, therefore, at low efficiency. One of the ways to achieve the objectives of the present invention is through a flow rate control system in refrigeration circuits comprising a hermetic compressor fluidly connected to a closed circuit (20). The closed circuit (20) comprising a condenser (11), an evaporator (12) and a fluid expansion device (17), the closed circuit (20) being filled with a fluid, the fluid expansion device (17) having a nominal expansion capacity and being positioned between the evaporator (12) and the condenser (11), the hermetic compressor (10) promoting a fluid flow inside the closed circuit (20), the closed circuit (20) having a circuit nominal flow rate capacity. In addition, the system comprises a flow control valve (15) which is positioned between an outlet of the condenser (11) and an inlet of the fluid expansion device (17), the flow control valve (15) being modulated so that the fluid passing through the fluid expansion device (17) is always at nominal expansion capacity. A method for controlling a refrigeration system is also disclosed.

5 Claims, 1 Drawing Sheet

(56) References Cited

U.S. PATENT DOCUMENTS

| | | | | |
|---|---|---|---|---|
| 4,766,735 | A * | 8/1988 | Gotou | 62/175 |
| 5,253,482 | A | 10/1993 | Murway | |
| 6,047,557 | A * | 4/2000 | Pham et al. | 62/228.5 |
| 2003/0131618 | A1 | 7/2003 | Doi et al. | |

FOREIGN PATENT DOCUMENTS

| | | |
|---|---|---|
| EP | 1 462 729 | 9/2004 |
| FR | 2 734 347 | 11/1996 |
| WO | WO 2005/022053 | 3/2005 |

OTHER PUBLICATIONS

The Written Opinion for PCT Application No. PCT/BR2007/000095; Filed Apr. 17, 2007; Date of Completion Oct. 5, 2007; Date of Mailing Oct. 12, 2007.
The Reply to Written Opinion dated Feb. 19, 2008.
The International Preliminary Report on Patentability, Jul. 2008.

* cited by examiner

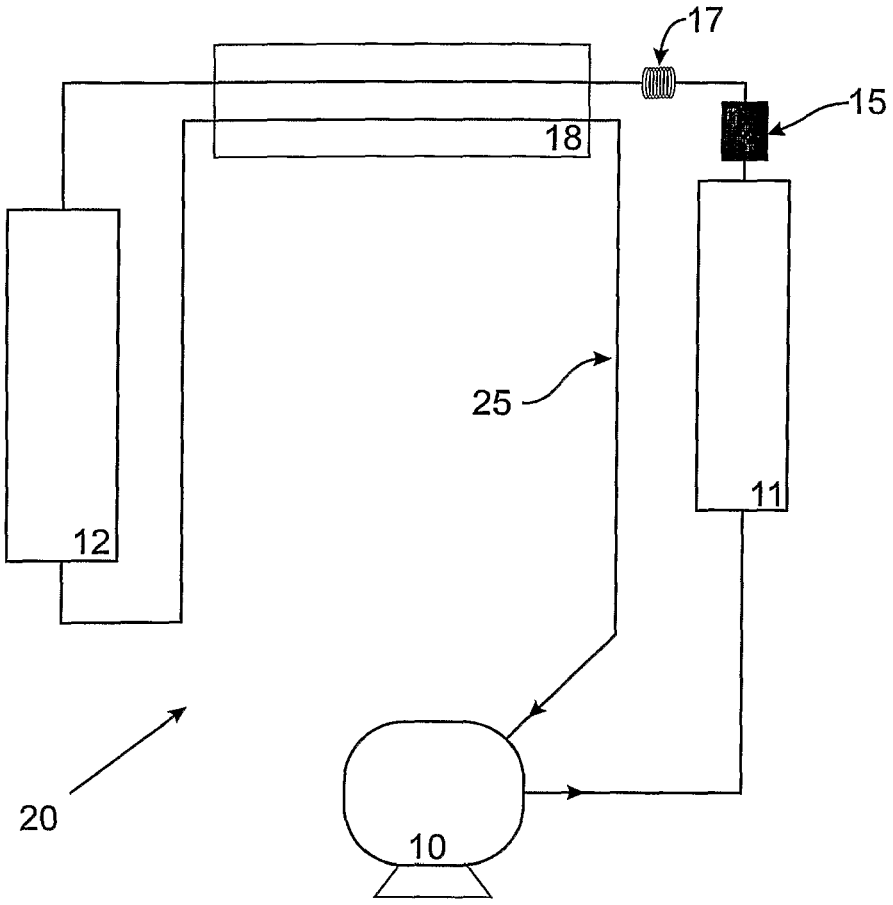
17
15
18
25
11
12
20
10

FLOW RATE CONTROL SYSTEM IN REFRIGERATION CIRCUITS, METHOD FOR CONTROLLING A REFRIGERATION SYSTEM AND A REFRIGERATION SYSTEM

The present invention relates to a flow rate control system in refrigeration circuits, to a method for controlling a refrigeration system and to a refrigeration system proper, which may include, for example, from a domestic refrigerator to an air conditioning system. In particular, the present invention is directed to a solution for the loss of efficiency in the capillary tube (or in the expansion valve in larger refrigeration systems), when the system load varies, making the capillary tube operate below its nominal capacity and, therefore, at low efficiency.

DESCRIPTION OF THE PRIOR ART

In general lines, the basic objectives of a refrigeration system are to keep a low temperature inside one (or more) compartment(s), using devices that transfer heat from inside these environments to the outside environment, making use of the temperature measurement inside these environment(s) to control the devices in charge of heat transfer, trying to maintain the temperature within predetermined limits for the type of refrigeration system in question.

Depending on the complexity of the refrigeration system and on the type of application, the temperature limits to be kept are more or less restricted. This happens because when the refrigeration system is designed it is optimized in order to obtain the lowest power consumption possible. As an example, the expansion system may be optimized to the temperature in which the power consumption will be measured, for example, 25° C.; however, as in the case of the expansion system (capillary tube) the temperature above or below 25° C. is fixed, the system will not operate properly. In addition, the more optimized the capillary tube is, the narrower its application field will be. For example, if the system has been optimized to no more than 25° C., the range in which the system will properly operate will be from 18 to 32° C., but if the system works from 10 to 43° C., the flow rate of the capillary tube should increase and this negatively affects the consumption.

A common way to transfer heat from inside a refrigeration system to the outside environment is by using a hermetic compressor connected to a closed circuit through which a cooling fluid circulates, this compressor having the function of promoting the flow of cooling gas inside this refrigeration system, being capable of causing a pressure difference between the points where the evaporation and the condensation of the cooling gas occur, enabling the heat transfer process to occur and the creation of a low temperature. To cause a pressure difference in the refrigeration circuit, a device called capillary tube or expansion valve is used, depending on the size of the system (for domestic systems, the capillary tube is used and, in large systems, the expansion valve is used).

DESCRIPTION OF THE PRIOR ART

In the prior art, the capillary tube is sized to a fixed capacity compressor and to a better performance condition at a single ambient temperature. With the variation of the ambient temperature and the internal load of the refrigeration system, this performance falls. For the variable capacity compressors, this problem worsens, since the capillary tube is sized to the maximum capacity of the compressor and, when it operates at low capacity, the capillary tube has a flow rate higher than what is pumped by the compressor, causing the efficiency of the system to fall. This loss may vary from between 5 to 15%, depending on the system and the ambient temperature.

In order to avoid this problem, some solutions describe the use of valves to control the fluid flow inside the refrigeration circuit. One of these solutions is disclosed in patent U.S. Pat. No. 6,047,556, describing the use of a control valve which is rapidly modulated to control the flow of the cooling fluid in the refrigeration circuit. In addition, this system uses an electronic expansion valve which can be controlled by a microprocessor. In spite of foreseeing the use of a control valve to modulate the amount of fluid in the circuit, it is not anticipated that the valve will be controlled in such a way as to optimize the operation of an expansion valve (or a capillary tube) so that it can operate always in optimal conditions.

Another prior art reference is patent document WO90/07683. In accordance with the teachings of this document, a control valve is used to modulate the quantity of fluid in a refrigeration circuit, but it is not anticipated that the control valve will be positioned before the inlet of the expansion valve so as to optimize its operation.

A further prior-art reference is patent application US2004/0187504 which describes the use of a valve before the inlet of the expansion valve, the modulation of this system being synchronized with the turning on and off the compressor without anticipating that the valve before the inlet of the capillary tube shall be modulated to control the fluid flow during the system operation.

BRIEF DESCRIPTION AND OBJECTS OF THE INVENTION

The objectives of the present invention are to optimize the operation of the capillary tube (or the expansion valve) by adding a flow control valve in order for it to work in all capacities so that the refrigeration system is always operating at the maximum possible efficiency.

In order to overcome the prior-art problems, that is, the use of an expansion valve (capillary tube) or a generically designated expansion device often in non-optimal conditions, the present invention discloses that the fluid circulating inside the valve should always operate under optimal conditions, and the fluid flow should be controlled only to be released to pass through (the expansion valve) the expansion device when it has reached the respective nominal operation value and thus arrive at a system that is efficient and has high flexibility, that is to say, that can operate under any condition of ambient temperature and thermal load, as well as in different refrigeration capacities imposed by the variable speed compressors.

Thus, in general lines, the proposed solution is to maintain the capillary tube originally designed for the system's maximum capacity (maximum flow rate) that is, at a nominal expansion capacity, or even superior, and add a valve (solenoid or another pulsating valve) between the outlet of the condenser and the inlet of the capillary tube. This valve may be electronically controlled by the compressor or by the system itself, for instance, being commanded by the electronic system of the compressor in the case of variable capacity compressors (VCCs) or by another electronic system that may be the thermostat of the refrigeration system or the electronic starting system of a conventional fixed capacity compressor.

This control will determine the modulation of the valve according to the capacity of the compressor, the load inside the system and the ambient temperature according to the need. Therefore, the control of the cooling agent flow will be carried out through the valve which will operate at the evaporation and condensation pressures, but the expansion of the cooling fluid will continue to occur through the capillary tube. The advantage of this type of configuration in relation to systems that use only the capillary tube lies in the flexibility of the system to work optimized in all the ambient temperature and thermal load conditions and in the different refrigeration capacities imposed by the variable speed compressors. In relation to systems that only use the expansion valve, the major advantages are the possibility of continuing to take advantage of the heat exchanger capillary tube—suction line and the fact that the expansion of the cooling agent only occurs in the capillary tube, avoiding problems in lowering the temperature of the valve body with the consequent ice formation over it. Ice formation occurs when it is an expansion valve directly applied on the evaporator, if it is inside the refrigeration system, the valve will transfer heat to the system since the high pressure side is hotter; however, if it is outside, the low pressure side is cold and will cause ice formation. In both cases, this affects the efficiency of the system. With the flow control valve, the same is applied between the outlet of the condenser and the inlet of the capillary tube, and this phenomenon does not occur.

One of the ways to achieve the objectives of the present invention is through a flow rate control system in refrigeration circuits comprising a hermetic variable capacity compressor fluidly connected to a closed circuit. The hermetic variable capacity compressor having electronic system to control the motor compressor. The closed circuit comprising a condenser, an evaporator, a flow rate control valve and a fluid expansion device, the closed circuit being filled with a fluid, the flow rate control valve being positioned between an outlet of the condenser and an inlet of the fluid expansion device, the fluid expansion device having a nominal expansion capacity and being positioned between the evaporator and the condenser. The hermetic variable capacity compressor promotes a variable fluid flow inside the closed circuit. In addition, the system comprises the electronic system of the hermetic variable capacity compressor which is configured to control the flow rate control valve, to always maintain the fluid passing through the fluid expansion device, at the same level as the nominal expansion capacity of the fluid expansion device.

Another way to achieve the objectives of the present invention is through a flow rate control system in refrigeration circuits comprising a hermetic variable capacity compressor fluidly connected to a closed circuit, the closed circuit comprising a condenser, an evaporator, a heat exchanger, a suction line and a fluid expansion device; the condenser being connected from the outlet of the hermetic variable capacity compressor in series with the expansion device, with the heat exchanger and the evaporator, the suction line being connected to an outlet of the evaporator which passes through the heat exchanger to the inlet of the hermetic compressor, the fluid expansion device having a nominal expansion capacity and being positioned between the evaporator and the condenser, the hermetic variable capacity compressor promoting a variable fluid flow inside the closed circuit, the closed circuit having a circuit nominal flow rate capacity, the system additionally comprising a flow rate control valve between the outlet of the condenser and before the inlet of a fluid expansion device and the fact the fluid expansion device has a nominal expansion capacity greater than or equal to the closed circuit nominal flow rate capacity, the flow rate control valve being pulsated so that the fluid is dammed in the condenser and released when it has reached an amount substantially equal to the nominal expansion capacity; in other words, the fluid is dammed (accumulated) in the condenser every time the valve closes, the expansion device should have a flow rate equal to or slightly greater than the needed one for the operating condition of the refrigeration system.

Still according to the present invention, a method of controlling a refrigeration system is provided, the system comprising a hermetic variable capacity compressor fluidly connected to a closed circuit, the closed circuit comprising a condenser, an evaporator and a fluid expansion device; the fluid expansion device having a nominal expansion capacity and being positioned between the evaporator and the condenser, the hermetic compressor promoting a fluid flow inside the closed circuit; a flow rate control valve being positioned between the outlet of the condenser and before the inlet of the fluid expansion device, and the method comprising the steps of accumulating the fluid in the condenser next to the flow rate control valve; keeping the flow rate control valve closed, while the quantity of fluid is below the nominal expansion capacity; and when the amount of fluid is equal to or greater than the nominal expansion capacity, pulsating the flow rate control valve to release the fluid until the amount has reached below the nominal expansion capacity.

BRIEF DESCRIPTION OF THE DRAWING

The present invention will be described in more details based on an example of an embodiment represented in FIG. 1, which represents a schematic diagram of a closed circuit, illustrating a compressor, a condenser, an evaporator and a fluid expansion device, a heat exchanger, the closed circuit being filled with a fluid.

DETAILED DESCRIPTION OF THE FIGURE

FIG. 1 depicts a closed circuit 20 comprising a condenser 11, an evaporator 12, a heat exchanger 18, a suction line 25 and a fluid expansion device 17, which may be a capillary tube or an expansion valve, as previously described.

In the configuration illustrated in the FIGURE, the condenser 11 is connected from the outlet of the hermetic variable capacity compressor 10 in series with the expansion valve 17, with the heat exchanger 18 and with the evaporator 12, the suction line 25 being connected to the outlet of the evaporator 12 and passing through the heat exchanger 18 to the inlet of the hermetic variable capacity compressor 10.

In another embodiment (not shown), the use of the heat exchanger 18 is discarded and the outlet of the evaporator 12 is connected to the hermetic variable capacity compressor 10, without changing the concepts of the system and the method of the present invention.

In terms of the operation of the flow control system in refrigeration circuits, the closed circuit 20 is filled with a cooling fluid, the hermetic variable capacity compressor 10 promotes a fluid flow inside the closed circuit 20, the closed circuit 20 having a circuit nominal flow rate capacity.

According to the teachings of the present invention, the fluid expansion device 17—which has a nominal expansion capacity—is positioned between the evaporator 12 and the condenser 11 and additionally the system is provided with a flow rate control valve 15, which is positioned between an outlet of the condenser 11 and an inlet of the fluid expansion device 17.

With regard to the features of the fluid expansion device 17, this should be designed so that the nominal expansion capacity is greater than or equal to the closed circuit nominal flow rate capacity 20, therefore, it is possible to modulate the flow rate control valve 15, so that the fluid is dammed in the condenser 11 and only released when it has reached a flow rate amount equal to the nominal expansion capacity, that is, this way, the expansion valve 17 will operate always under optimal conditions resulting in maximum efficiency.

The flow rate control valve 15 may be, for example, a pulsating valve, a solenoid valve or another type of valve with a rapid response to control the fluid flow in a suitable way to always maintain the closed circuit operating properly and so that the fluid expansion valve 17 may continue operating substantially at nominal expansion capacity of opening and closing proportionally to the ambient temperature.

In terms of the command of the flow rate control valve 15, it should be controlled to be pulsated intermittently to gradually release the fluid when it has a quantity substantially equal to the nominal expansion capacity, the damming time being variable according to the demand of the refrigeration system.

The control of the system as a whole should be done through an electronic control (not shown) present in the compressor or the system. The flow modulation may be effected through the on/off control of the valve (open and close) in short time intervals or through the variation of the flow between a minimum value equal to zero (totally closed valve) and a maximum value (totally open valve) with infinite intermediary steps. In other words, a control valve has two positions: open or closed so that it can be 100% open or pulsated with pulse variations between open or closed from 0 to 100%. As an example, to achieve 50% of the capacity of a compressor, the valve could be kept 10 seconds open and 10 seconds closed, varying these times.

In order to operate the flow rate control system in refrigeration circuits, which are objects of the present invention, the following steps are foreseen:

modulating the flow rate control valve 15 proportionally according to the capacity of the compressor/system, keeping the flow rate control valve 15 closed, while the amount of fluid is below the nominal expansion capacity, and when the quantity of flow is equal to or greater than the nominal expansion capacity, pulsating the flow rate control valve 15 to release the fluid, until the amount has reached a nominal expansion capacity. In this step, the flow rate control valve pulsating 15 is carried out intermittently.

The teachings of the present invention are applicable to any refrigeration system, which may include domestic refrigeration systems, industrial refrigeration systems, air conditioning systems etc.

Having described examples of the invention with reference to its preferred embodiments, it is to be understood that the scope of the present invention embraces other possible variations, being limited solely by the appended claims, including the possible equivalents therein.

The invention claimed is:

1. A flow rate control system in refrigeration circuits, the circuit comprising a hermetic variable capacity compressor fluidly connected to a closed circuit, the hermetic variable capacity compressor having an electronic system to control the compressor, the closed circuit comprising a condenser, an evaporator, a heat exchanger, a suction line and a fluid expansion valve;

a flow rate control valve positioned between an outlet of the condenser and before an inlet of the fluid expansion valve;

the condenser being connected from the outlet of the hermetic variable capacity compressor in series with the expansion valve, with the heat exchanger and with the evaporator, the suction line being connected to the outlet of the evaporator which passes through the heat exchanger to the inlet of the hermetic variable capacity compressor;

the fluid expansion valve having a nominal expansion capacity and being positioned between the evaporator and the condenser, the hermetic variable capacity compressor promoting a fluid flow inside the closed circuit, the closed circuit having a circuit nominal flow rate capacity, the flow rate control system wherein the electronic system of the hermetic variable capacity compressor is configured to control the flow rate control valve, to always maintain the fluid passing through the fluid expansion device at the same level as the nominal expansion capacity of the fluid expansion device, pulsating the flow rate control valve proportionally to the speed of the hermetic variable capacity compressor so that the fluid is dammed in the condenser and released when it has reached an amount substantially equal to the nominal expansion capacity.

2. A system according to claim 1, wherein the expansion valve is a capillary tube.

3. A system according to claim 2, wherein the flow rate control valve is a solenoid valve.

4. A refrigeration system comprising a refrigeration circuit having a flow control system as defined in claim 1.

5. A method for controlling a refrigeration system, the system comprising a hermetic variable capacity compressor fluidly connected to a closed circuit, the closed circuit comprising a condenser, an evaporator and a fluid expansion valve;

the fluid expansion valve having a nominal expansion capacity and being positioned between the evaporator and the condenser, a flow rate control valve positioned between the outlet of the condenser and before the inlet of the fluid expansion valve, the hermetic variable capacity compressor promoting a variable fluid flow inside the closed circuit, the closed circuit having a circuit nominal flow rate capacity, the method comprising the steps of:

electronically modulating the flow rate control valve proportionally to the capacity of the hermetic variable capacity compressor, keeping the flow rate control valve closed, while the amount of fluid is below the nominal expansion capacity, and when the quantity of flow is equal or greater than the nominal expansion capacity, intermittently pulsating the flow rate control valve to release the fluid, until the quantity has reached an amount below the nominal expansion capacity.

* * * * *

UNITED STATES PATENT AND TRADEMARK OFFICE

CERTIFICATE OF CORRECTION

PATENT NO. : 8,627,676 B2
APPLICATION NO. : 12/297671
DATED : January 14, 2014
INVENTOR(S) : Thiessen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1362 days.

Signed and Sealed this
Twenty-second Day of September, 2015

Michelle K. Lee

Michelle K. Lee
*Director of the United States Patent and Trademark Office*